United States Patent [19]

Kato et al.

[11] Patent Number: 4,842,975

[45] Date of Patent: Jun. 27, 1989

[54] METHOD OF MAKING LIQUID DEVELOPER FOR ELECTROSTATIC PHOTOGRAPHY

[75] Inventors: Eiichi Kato; Kazuo Ishii; Hiroshi Ishibashi; Shigeyuki Dan; Hidefumi Sera, all of Kanagawa, Japan

[73] Assignee: Fuji Photo Film Co., Ltd., Kanagawa, Japan

[21] Appl. No.: 136,517

[22] Filed: Dec. 22, 1987

Related U.S. Application Data

[63] Continuation of Ser. No. 912,663, Sep. 29, 1986, abandoned, which is a continuation of Ser. No. 706,993, Feb. 28, 1985, abandoned.

[30] Foreign Application Priority Data

Feb. 28, 1984 [JP] Japan ..... 59-36789

[51] Int. Cl.[4] ..... G03G 9/12

[52] U.S. Cl. ..... 430/137; 430/114

[58] Field of Search ..... 430/137, 114

[56] References Cited

U.S. PATENT DOCUMENTS

| | | | |
|---|---|---|---|
| 3,417,019 | 12/1968 | Beyer | 430/115 |
| 3,849,165 | 11/1974 | Stahly et al. | 430/114 X |
| 3,883,440 | 5/1975 | Tamai et al. | 430/114 |
| 3,900,412 | 8/1975 | Kosel | 430/115 X |

FOREIGN PATENT DOCUMENTS

| | | |
|---|---|---|
| 2095685 | 10/1982 | European Pat. Off. . |
| 1772825 | 9/1970 | Fed. Rep. of Germany . |
| 25322 | 1/1977 | Fed. Rep. of Germany . |
| 2936042 | 3/1980 | Fed. Rep. of Germany . |
| 2196489 | 3/1974 | France . |
| 2029040 | 3/1980 | United Kingdom . |

*Primary Examiner*—J. David Welsh

*Attorney, Agent, or Firm*—Sughrue, Mion, Zinn, Macpeak & Seas

[57] ABSTRACT

A liquid developer for electrostatic photography is described, comprising at least a resin dispersed in a non-aqueous solvent having an electric resistance of at least $10^9$ ohms.cm and a dielectric constant of not more than 3.5. The resin is a copolymer resin obtained by polymerizing a solution containing at least one monofunctional monomer (A) which is soluble in the non-aqueous solvent but becomes insoluble upon polymerization and at least one specified monomer (B) containing an aliphatic group having at least 8 carbon atoms and being copolymerizable with the monomer (A), in the presense of a resin not containing a grafting group polymerizable with the monomers and being soluble in the non-aqueous solvent. The resin may be colored by dissolving at least one organic dye in the dispersion of the resin and heating the mixture. The developer has excellent dispersion stability, redispersibility, fixability and preservability.

25 Claims, No Drawings

METHOD OF MAKING LIQUID DEVELOPER FOR ELECTROSTATIC PHOTOGRAPHY

This is a continuation of application Ser. No. 912,663 filed Sept. 29, 1986, now abandoned, which is a continuation of application Ser. No. 706,993 filed Feb. 28, 1985, now abandoned.

FIELD OF THE INVENTION

This invention relates to a liquid developer for electrostatic photography comprising at least a resin dispersed in a non-aqueous solvent having an electric resistance of at least $10^9$ ohms.cm and a dielectric constant of not more than 3.5. More specifically, this invention relates to a liquid developer having excellent preservability, stability, redispersibility and fixability.

BACKGROUND OF THE INVENTION

Generally, liquid developers for electrostatic photography are obtained by uniformly dispersing inorganic or organic pigments or dyes such as carbon black, nigrosine and phthalocyanine blue and natural or synthetic resins such as alkyd resins, acrylic resins, rosin and synthetic rubbers in liquids having high insulating properties and low dielectric constants, such as petroleum-type aliphatic hydrocarbons, and further adding metal soaps, lecithin, linseed oil, higher fatty acids, a polymer containing vinylpyrrolidone, etc. for the purpose of making the charge characteristics of the dispersed particles uniform and strong.

In a developing process, such a developer undergoes electrophoresis according to the charge of the electrostatic latent image formed on the surface layer of the electrophotographic material or the electrostatic recording material and becomes fixed to that surface to form a visible image (copied image). However, the conventional liquid developers are disadvantageous in that a dispersion stabilizing resin (i.e., dispersant) or a charge controlling agent diffuses in the liquid to obscure the charge characteristics. As a result, the copied images lose clarity due to the reduction of image density and fixation, the increase of background fogging, etc.

In addition, these developers are susceptible to sedimentation, flocculation, etc. of the dispersed particles over the course of time. Once these particles have been sedimented or flocculated, they cannot be redispersed. Hence, it is difficult to use such developers.

Furthermore, because of these disadvantages, conventional liquid developers are also unsuitable for use in offset printing, or for transfer purposes, for example charge transfer, press transfer or magnetic transfer.

As a method of overcoming these problems, it has been suggested to stabilize the dispersion of the particles by grafting a polymer to the surface of a pigment such as carbon black. However, a developer obtained by using this method has the disadvantage that the relative amount of the resinous component which adheres to the image surface together with the pigment is small, and the strength of the formed image after fixation is insufficient.

Accordingly, when an image is formed on a zinc oxide photosensitive sheet using such developer and the sheet is used as an offset printing plate, the hydrophobic property of the printing plate to printing inks and the number of printed copies which can be produced thereby are insufficient due to the aforesaid causes.

U.S. Pat. No. 3,990,980 discloses another method in which monomers are polymerized in the aforesaid non-aqueous solvent in the presence of a dispersant having a grafting group to form fine resin particles, and these resin particles are used as toner particles. However, the use of such a liquid developer still causes problems. Specifically, the dispersion stability of this developer against spontaneous sedimentation is improved to some extent, but still remains insufficient. When such a developer is used in a developing device, the toner adhering to the various parts of the device solidifies in film form, and it is difficult to redisperse them. Furthermore, the use of such a developer causes problems in the device itself, the stain of copied images or etc. Moreover, there is a marked restriction on the combination of dispersant having a grafting group and monomer employed in order to form satisfactory resin particles by the above method. Further, generally, the resulting resin particles contain large amounts of coarse particles and have a broad particle size distribution. Another problem is that desirable dispersant have to be synthesized through complex manufacturing steps.

SUMMARY OF THE INVENTION

Generally stated, the present invention overcomes the problems of the conventional liquid developers described above.

A specific object of this invention is to provide a liquid developer having excellent dispersion stability, redispersibility and fixability.

Another object of this invention is to provide a liquid developer which enables an offset printing plate to have excellent hydrophobic property to printing inks and printing life to be prepared by an electrophotographic process.

Still another object of this invention is to provide a liquid developer suitable for various electrostatic photographic applications and various electrostatic transfer applications in addition to the aforesaid application.

A further object of this invention is to provide a liquid developer which can be used in all systems in which liquid developers can be used, for example, in systems involving ink jet recording, cathode ray tube recording and recording of various changes such as pressure changes and electrostatic changes.

The present invention which meets the above objects is a liquid developer for electrostatic photography comprising at least (1) a resin (inclusive of a resin insoluble in a non-aqueous solvent) dispersed in a non-aqueous solvent having an electric resistance of at least $10^9$ ohms.cm and a dielectric constant of not more than 3.5, said resin being a copolymer resin obtained by polymerizing a solution containing at least one monofunctional monomer (A) which is soluble in the non-aqueous solvent but becomes insoluble upon polymerization and at least one monomer (B) containing an aliphatic group having at least 8 carbon atoms, said monomer (B) being copolymerizable with the monomer (A) and being represented by the following formula (I)

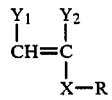

(I)

wherein R represents an aliphatic group having at least 8 carbon atoms, X represents —COO—, —CONH—, $$-\overset{\overset{\displaystyle R'}{|}}{C}ON-,$$

wherein R' represents an aliphatic group, —OCO—, —$CH_2OCO$— or —O—, and $Y_1$ and $Y_2$ are the same or different and each represents hydrogen, an alkyl group, —COOR" or —$CH_2COOR$", wherein R" represents an aliphatic group, in the presence of (2) a resin (dispersant) which is soluble in said solvent and having no grafting group polymerizable with the monomers.

DETAILED DESCRIPTION OF THE INVENTION

The non-aqueous solvent having an electric resistance of at least $10^9$ ohms.cm and a dielectric constant of not more than 3.5 may preferably be a straight-chain or branched-chain aliphatic hydrocarbon, an alicyclic hydrocarbon, an aromatic hydrocarbon, a halogenated hydrocarbon, etc.

In view of volatility, stability, toxicity and odor, octane, isooctane, decane, isodecane, nonane, dodecane, isododecane, and decalin; and Isopar E, Isopar G, Isopar H and Isopar L (trade names for products of Exxon Company), Shell Sol 71 (a trade name of a product of Shell Oil Company), and Amsco OMS and Amsco 460 solvent (trade names for products of American Mineral Spirits Company), which are isoparaffin type petroleum solvents are more preferably used either singly or in combination.

The resin dispersible in a non-aqueous solvent is produced by polymerizing the monomers in the non-aqueous solvent in the presence of a dispersant.

Basically, any non-aqueous solvents miscible with a non-aqueous solvent (a carrier liquid) of the aforesaid electrostatic photographic liquid developer can be used. Usually, however, it is preferred to use the same solvent as the carrier liquid in the stage of preparing the dispersed resin.

Specifically, straight-chain or branched-chain aliphatic hydrocarbons, alicyclic hydrocarbons, aromatic hydrocarbons and halogenated hydrocarbons are preferred as the solvent used in the production of the resin to be dispersed.

Specific examples of preferred solvents are hexane, octane, isooctane, decane, isodecane, nonane, dodecane, and isododecane; and Isopar E, Isopar G, Isopar H, Isopar L, Shell Sol 71 and Amsco OMS, which are isoparaffin type petroleum solvents.

The dispersant required for polymerizing the monomers in a non-aqueous solvent and forming the resulting polymer which is insoluble in the aforesaid solvents is a resin which does not contain a grafting group polymerizable with the monomers, and conventional known dispersants can be used. Specifically, various synthetic or natural resins soluble in non-aqueous solvents may be used singly or in combination. For example, there can be used polymers or copolymers of acrylic, methacrylic or crotonic esters which contain alkyl or alkenyl chains having 6 to 32 carbon atoms in total (these aliphatic groups may have a substituent such as halogen atoms, a hydroxyl group, an amino group or alkoxy groups, or the carbon-carbon bond of the main chain may be interrupted by a hetero atom such as oxygen, sulfur or nitrogen), higher fatty acid vinyl esters, alkyl vinyl ethers or olefins such as butadiene, isoprene or diisobutylene and copolymers obtained by polymerizing monomers capable of forming polymers soluble in the aforesaid non-aqueous solvents and at least one of the various monomers described below in a proportion such that the resulting copolymers are soluble in non-aqueous solvents. Examples of such monomers include vinyl acetate, allyl acetate, methyl, ethyl or propyl esters of acrylic, methacrylic, crotonic, maleic and itaconic acids, styrene and styrene derivatives (such as vinyltoluene and α-methylstyrene), unsaturated carboxylic acids such as acrylic acid, methacrylic acid, crotonic acid, maleic acid and itaconic acid, anhydrides of these unsaturated carboxylic acids, and monomers containing various polar groups such as a hydroxyl group, an amino group, an amido group, a cyano group, a sulfonic acid group, a carbonyl group, a halogen atom or a heterocyclic group, for example hydroxyethyl methacrylate, hydroxyethyl acrylate, diethylaminoethyl methacrylate, N-vinylpyrrolidone, acrylamide, acrylonitrile, 2-chloroethyl methacrylate and 2,2,2-trifluoroethyl methacrylate.

In addition to the above synthetic resins, there may also be useful natural resins such as alkyd resins, alkyd resins modified with various fatty acids, linseed oil and modified polyurethane resins.

The monomers used in the production of the resin dispersible in the non-aqueous solvent may be classified into the monofunctional monomers (A) which are soluble in the aforesaid solvents but become insoluble upon polymerization and monomers (B) which are copolymerizable with monomers (A), have an aliphatic group with at least 8 carbon atoms, and are represented by general formula (I).

Examples of the monomers (A) include vinyl and allyl esters of aliphatic carboxylic acids having 1 to 3 carbon atoms (such as acetic acid, propionic acid, butyric acid and monochloroacetic acid), $C_1$–$C_3$ alkyl esters or alkylamides of unsaturated carboxylic acids such as acrylic acid, methacrylic acid, crotonic acid, itaconic acid and maleic acid, styrene and styrene derivatives such as vinyltoluene and α-methylstyrene, unsaturated carboxylic acids such as acrylic acid, methacrylic acid, crotonic acid, maleic acid and itaconic acid and anhydrides of these unsaturated carboxylic acids, hydroxyethyl methacrylate, hydroxyethyl acrylate, diethylaminoethyl methacrylate, N-vinylpyrrolidone, acrylonitrile or etc.

The monomers (B) of general formula (I) used in this invention will be further described. Preferably, in general formula (I), R represents an alkyl or alkenyl group having at least 10 carbon atoms in total which may be substituted; X represents —COO—, —CONH—, $$-\overset{\overset{\displaystyle R'}{|}}{C}ON-$$

[wherein R' represents an aliphatic group (such as an alkyl, alkenyl or aralkyl group) having 1 to 32 carbon atoms], —OCO—, —$CH_2OCO$— or —O—; and $Y_1$ and $Y_2$ are the same or different and each represents hydrogen, a methyl group or —COOR" or —$CH_2COOR$" (in which R" represents an alkyl, alkenyl, aralkyl or cycloalkyl group having 1 to 32 carbon atoms).

More preferably, in general formula (I), X represents —COO—, —CONH— or

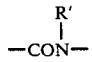

(R′ is as defined above); $Y_1$ and $Y_2$ are the same or different and each represents hydrogen or a methyl group; and R is as defined above.

Specific examples of monomers (B) of general formula (I) include esters of unsaturated carboxylic acids having aliphatic groups with 10 to 32 carbon atoms in total (which may contain a substituent such as a halogen atom, a hydroxyl group, an amino group or an alkoxy group, or in which the carbon-carbon bond in the main chain may be interrupted by a hetero atom such as oxygen, sulfur or nitrogen) (examples of the aliphatic groups are decyl, dodecyl, tridecyl, tetradecyl, hexadecyl, octadecyl, docosanyl, dodecenyl, hexadecenyl, oleyl, linoleyl and docodecyl groups), such as acrylic acid, methacrylic acid, crotonic acid, maleic acid and itaconic acid; amides of the aforesaid unsaturated carboxylic acids (the aliphatic groups may be the same as those exemplified with regard to the esters); vinyl or allyl esters of higher fatty acids such as lauric acid, myristic acid, stearic acid, oleic acid, linoleic acid and behenic acid; and vinyl ethers having an aliphatic group containing 10 to 32 carbon atoms in total as a substituent (the aliphatic group may be the same as the aliphatic groups of the unsaturated carboxylic acids).

The dispersed resin of this invention is composed of at least one monomer A and at least one monomer B. It is important that the desired dispersed resin can be obtained if the resin synthesized from these monomers is insoluble in the non-aqueous solvent. More specifically, the monomer (B) of general formula (I) is used in an amount of preferably 0.1 to 30 mole %, more preferably 0.5 to 5 mole %, based on the amount of the monomer (A) which becomes insoluble upon polymerization. The dispersed resin in accordance with this invention have a molecular weight of $10^3$ to $10^6$, preferably $10^4$ to $10^6$.

Specific examples of the dispersed resin used in this invention are given below. The scope of the invention, however, is not limited to these specific examples.

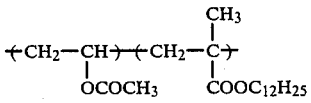

(1)

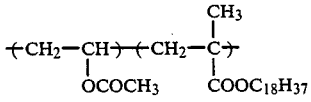

(2)

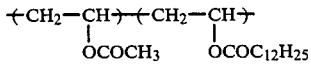

(3)

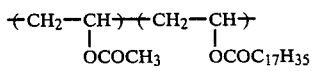

(4)

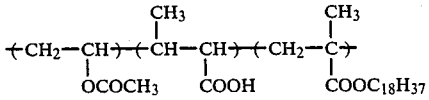

(5)

-continued

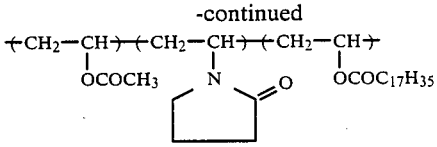

(6)

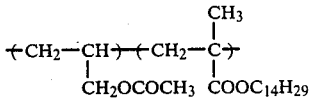

(7)

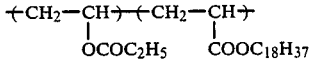

(8)

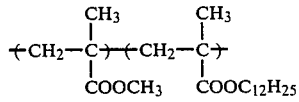

(9)

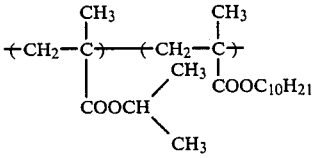

(10)

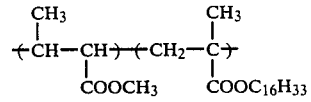

(11)

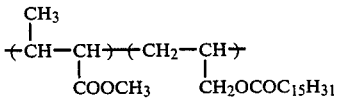

(12)

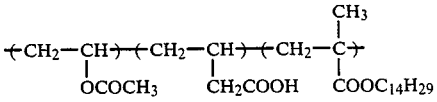

(13)

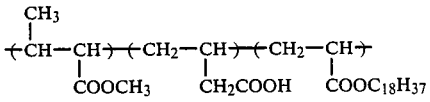

(14)

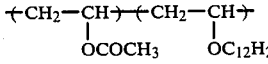

(15)

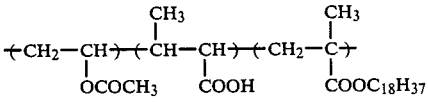

(16)

The dispersed resin used in this invention can be produced generally by heating the dispersant, monomer (A) and monomer (B) in the non-aqueous solvent in the presence of a polymerization initiator such as benzoyl peroxide, azobisisobutyronitrile and butyllithium to polymerize monomers (A) and (B). Specifically, the polymerization initiator is added to a mixed solution of the dispersant, monomer (A) and monomer (B); monomers (A) and (B) together with the polymerization initiator are added dropwise to a solution of the dispersant; to a mixed solution containing all of the resin and a part of a mixture of monomers (A) and (B), the polymerization initiator and the remainder of the monomeric mixture are added; or a mixed solution of the dispersant and the monomers are added together with the polymerization initiator to the non-aqueous solvent. By any of these methods, the dispersed resin in accordance with this invention can be produced.

The total amount of monomers (A) and (B) is about 5 to about 80 parts by weight, preferably 10 to 50 parts by weight, per 100 parts by weight of the non-aqueous solvent.

The amount of the soluble resin as a dispersant is 1 to 100 parts by weight, preferably 5 to 50 parts by weight, per 100 parts by weight of the entire monomers.

The amount of the polymerization initiator is suitably 0.1 to 5% by weight, preferably 0.5 to 3% by weight, based on the total weight of the monomers.

The polymerization temperature is about 50° to about 180° C., preferably 60° to 120° C., and the reaction time is preferably 1 to 15 hours.

The resin dispersible in the non-aqueous solvent produced by this invention as described above is present as fine particles having a uniform particle size distribution, and exhibits very stable dispersibility. In particular, even when it is repeatedly used in a developing device, it retains good dispersibility and can be easily re-dispersed. In addition, its adhesion to the parts of the device is not at all observed. When it is completely fixed by heating for example, it forms a firm film and shows good fixability.

Compounds heretofore used as monomer (A), such as methacrylates, acrylates, vinyl esters of fatty acids and acryl esters of fatty acids, usually have an alkyl group having 1 to 4 carbon atoms, and not more than 6 carbon atoms at the highest, in the molecule. Hence, the resulting resin might dissolve in the non-aqueous solvent and the formation of resin particles might become difficult. Or the softening point of the resulting resin will be lowered, and it will have weak resistance to thermal changes and poor preservability. In contrast, the dispersed resin obtained by polymerizing monomer (A) which becomes insoluble upon polymerization with a small amount (0.5 to 3 mole %) of the monomer (B) being copolymerizable with the monomer (A) and containing an alkyl or alkenyl group having at least 8 carbon atoms forms monodisperse resin particles of the desired average particle diameter and has markedly improved redispersibility without causing the aforesaid solubilization of the resin and the lowering of its softening point to an undesirable degree.

If, on the other hand, a monomer having an alkyl or alkenyl group with 4 to 6 carbon atoms (such as butyl methacrylate, hexyl methacrylate, hexyl acrylate, vinyl butyrate, vinyl caproate or allyl caproate) is used, large particles (at least 0.5 μm) exist in a large amount in the resulting dispersed resin, and the particles are no longer monodispersed ones. At the same time, the resin particles can scarcely be re-dispersed.

In contrast to resin particles obtained in the presence of monomer (B) during polymerization and particle formation as in the present invention, resin particles obtained without using monomer (B), a product obtained by adding monomer (B) to a dispersion of resin particles after polymerization of monomers (A) and particle formation, and resin particles obtained by polymerizing monomers (A) in the presence of a previously added polymer of monomers (B) assumed to be obtained by polymerization of monomers (B) totally irrespective of monomer (A), have been found to be difficult to disperse and markedly adhere and contaminate the developing device.

The above experimental facts have led to the belief that the marked increase in performance in accordance with this invention is due to the presence of a soluble component of monomer (B) on the interfaces of the particles of the insolubilized and dispersed resin, and to the consequent modification of the particle interface in some way.

If required, a coloring agent may be used in this invention. There is no particular restriction on the coloring agent, and any known conventional pigments or dyes can be used. The amount of the coloring agent is suitably 0.02 to 20 g/l, preferably 0.06 to 10 g/l.

When it is desired to color the dispersed resin itself, one coloring method is to disperse a pigment or dye physically in the dispersed resin. Many pigments and dyes which can be used are known. Examples include magnetic iron oxide powder, lead iodide powder, carbon black, nigrosine, Alkali Blue, Hansa Yellow, Quinacridone Red and Phthalocyanine Blue.

The colored resin dispersion in accordance with this invention can also be produced by another method which comprises dissolving at least one organic dye, and as required the aforesaid dye, in a dispersion of the resin particles, adding a second solvent miscible with the non-aqueous solvent and capable of at least swelling the aforesaid resin particles, and heating the mixture.

For example, the resin particles are dyed under heating with a dye being difficultly soluble, or insoluble, in the non-aqueous solvent and capable of dissolving in the monomers constituting the copolymer, and as required, the second solvent may be caused to be present together at this time.

It is presumed that the resin particles are dyed by the impregnation or adhesion of the used dye in or to the copolymer particles.

It is preferable therefore to select a dye most suitable for dyeing depending upon the constituent components of the copolymer resin.

For example, known disperse dyes may be cited for use in dyeing polyesters, polyacrylic resins, polyacrylonitrile resin, etc. Specific examples include Celliton Fast Yellow RR, Kayalon Fast Yellow G, Kayalon Fast Brown R, Kayalon Fast Scarlet B, Celliton Fast Rubine 3B, Celliton Fast Scarlet R, Kayalon Fast Rubine B, Kayalon Fast Red R, Miketon Fast Pink FR, Kayalon Fast Violet BB, Miketon Fast Violet BB, Kayalon Fast Blue FN, Kayalon Fast Blue Green B, Sumikaron Yellow FG, Sumikaron Blue BR, and Sumikaron Navy Blue R (trade names preceded by Celliton designate products of BASF; trade names preceded by Kayalon, products of Nippon Kayaku Co., Ltd.; trade names preceded by Miketon, products of Mitsui Chemical Co., Ltd.; and trade names preceded by Sumikaron, products of Sumitomo Chemical Co., Ltd.).

Basic dyes can be cited as another example. Specific examples of the basis dyes include Flavine 8G, Auramine, Crystal Violet, Methylene Blue, Rhodamine 6G, Malachite Green, Sumiacryl Yellow 3G, Sumiacryl Yellow 3R, Sumiacryl Orange G, Sumiacryl Orange R, Aizen Cathilon Pink, Aizen Cathilon Red 6BH, Aizen Basic Cyanine 6GH, and Primocyanine BX (trade names preceded by Sumiacryl designate products of Sumitomo Chemical Co., Ltd., and trade names preceded by Aizen Cathilon, products of Hodogaya Chemical Co., Ltd.). The basic dyes described in Masao Iizuka, "Dyeing Industry" (Japanese-language publication), 13, 429–448 (1965) may also be cited.

The second solvent, optionally used, miscible with the non-aqueous solvent and capable of dissolving the dye and at least swelling the resin particles is suitably any of the monomers used as constituent components of the resin. The use of the monomers has the advantage that deleterious effects such as the dissolving or flocculation of the resin particles which would occur when using other solvents can be avoided. However, ethanol, acetone and ethyl acetate, for example, which meet the aforesaid requirements may be used as the second solvent if the amounts of such solvents are adjusted.

If there is a sufficient amount of the monomer residue when the resin particles are formed, for example, by the aforesaid polymerization and particle formation method, it is not necessary to add the second solvent to the dispersion of the resin particles. If, however, the amount of the monomer residue is small, the second solvent must be added to the dispersion so that the amounts of the monomers and the second solvent become at least one-tenth of the weight of the resin particles in the dispersion.

The addition of the second solvent to the dispersion of the resin particles may be effected by adding the dye as a solution in the second solvent; or by adding the dye as a powder to the dispersion and adding the second solvent before or after the addition of the dye. In any case, it is sufficient that in the stage of removing the second solvent, the dispersion of the resin particles contains the dye and the second solvent. It is not always necessary, however, that the addition of the dye and the second solvent be completed before the stage of removing the second solvent. For example, the dye and/or the second solvent may be additionally supplied while removing the second solvent. The amount of the second solvent is generally 0.1 to 10 times the weight of the resin particles in the dispersion, but in view of the need for removing it under reduced pressure in a subsequent step, its amount preferably does not exceed one-third of the volume of the dispersion of the resin particles.

This range, however, is not limitative since an optimal proportion of the second solvent relative to the resin particles can exist outside the aforesaid range depending upon the types of the dye, resin particles, nonaqueous solvent and second solvent used.

The second solvent is removed while the dye and the second solvent are added to the dispersion and mixed or after the mixing has ended. The step of removing the second solvent is performed by reducing the pressure of the dispersion of the resin particles containing the dye and the second solvent with or without heating.

The amount of the dye used may be at least 0.5% by weight based on the weight of the resin particles in the dispersion, but to obtain a good color density, it is preferably at least 3% by weight. There is no particular upper limit to the amount of the dye used. Usually, however, the dye is used in an amount of up to 20% by weight at the largest.

The heating temperature for dyeing is 40° to 150° C., preferably 80° to 120° C. The heating time is 30 minutes to 12 hours, preferably 1 to 5 hours.

Mordant dyeing is another method for dyeing the dispersed resin particles. According to this method, the resin particles are dyed with a basic dye (cationic dye) when at least one component constituting the dispersed resin particles contains an acidic group (such as a carboxyl group), or with an acidic dye when at least one component constituting the dispersed resin particles contains a basic group. This method is thus based on ionic bonding between the acidic group and the basic group.

Examples of the basic dye for dyeing the resin particles composed of a carboxyl group-containing copolymer are the above-exemplified dyes and Aizen Victoria Blue BH, Aizen Victoria Pure Blue BOH, Aizen Cathilon Grey BLH and Aizen Cathilon Black GH (products of Hodogaya Chemical Co., Ltd.).

The dye used for dyeing the resin particles composed of a basic group-containing copolymer is a dye containing a carboxyl group or a sulfonic acid group, and specific examples include Kiton Blue A (CIBA Company), Alizarine Astrol B (Ikeda Chemical Co., Ltd.), Kayanol Blue N 2G (Nippon Kayaku Co., Ltd.), Kayanol Blue BR (Nippon Kayaku Co., Ltd.), Suminol Fast Sky Blue B (Sumitomo Chemical Co., Ltd.), Alizaline Light Brown BL (Mitsubishi Chemical Co., Ltd.), Aizen Eosine GH (Hodogaya Chemical Co., Ltd.), and Alizarinol R (Yamada Chemical Co., Ltd.). These acid dyes may also be used after, as required, the carboxyl group or the sulfonic acid group therein has been converted into its free acid, its salt with a metal, its salt with an organic base, or its quaternary ammonium salt.

The amount of the dye used and the dyeing conditions are the same as those described above with regard to the physical dyeing.

The non-aqueous colored dispersed resin produced as above by this invention is present as fine particles with a uniform particle size distribution and shows very stable dispersibility. In particular, even when it is used repeatedly for a long period of time in a developing device, it has good dispersibility and can be easily redispersed. Consequently, it does not at all adhere to, and contaminate, the various parts of the device.

Various additives may be incorporated as desired in the liquid developer of this invention in order to strengthen its charge characteristics or improve the quality of images. Such additives are described specifically, for example, in Yuji Harasaki, "Electrophotography" (Japanese-language publication), Vol. 16, No. 2, page 44. Examples of the additives are metal salts of di-2-ethylhexylsulfosuccinic acid, metal naphthenates, metal salts of higher fatty acids, lecithin, and poly(vinyl pyrrolidone).

Furthermore, the half alkylamide of diisobutylene/maleic acid copolymer described in Japanese Patent Publication No. 26594/74, and the copolymer having a half maleinamide component and a meleimide component as recurring units and prepared by the reaction of a copolymer of maleic anhydride with an amino compound as described in Japanese Patent Application No. 36787/84 may be used to adjust the charge characteristics of the liquid developer of this invention.

The amounts of the principal ingredients of the liquid developer of this invention are described below.

The amount of the dispersed resin of this invention is preferably 0.5 to 50 parts by weight per 1000 parts by weight of the non-aqueous solvent (carrier liquid). If it is less than 0.5 part by weight, the density of the developed image is insufficient. If it is above 50 parts by weight, fogging of a non-image area tends to occur. A resin soluble in the carrier liquid, such as the aforesaid dispersant, may be used as required in an amount of about 0.5 to about 100 parts by weight, preferably about 0.5 to 50 parts by weight, per 1000 parts by weight of the carrier liquid. The aforesaid charge adjusting agents are preferably in an amount of 0.001 to 1.0 part by weight, more preferably 0.005 to 0.5 part by weight, per 1000 parts by weight of the carrier liquid.

As required, various other additives may be used. The upper limit of the total amount of the additives is set by the electrical resistance of the developer. Since when the liquid developer from which the toner particles have been removed has an electric resistance of less than $10^9$ ohms.cm, a good quality image of a continuous tone is difficult to obtain, the amounts of the additives should be controlled so as to conform to this limit.

Some embodiments of the practice of this invention are given below. It should be understood however that the scope of this invention is not limited thereto.

PRODUCTION EXAMPLE 1

Production of resin particles [Compound No. (1)]:

A mixed solution composed of 12 g of poly(lauryl methacrylate), 100 g of vinyl acetate, 3 g of lauryl methacrylate and 385 g of isododecane was heated to 70° C. with stirring in a nitrogen current, and after adding 1.7 g of 2,2'-azobis(isobutyronitrile) (AIBN for short), reacted for 6 hours. Thirty minutes after the addition of the polymerization initiator, the uniform solution began to become whitely turbid, and the reaction temperature rose to 85° C. After cooling, the reaction mixture was passed through a 200-mesh nylon cloth. The resulting white dispersion was a latex having a polymerization conversion of 85% and an average particle diameter of 0.20 μm.

PRODUCTION EXAMPLE 2

Production of resin particles [Compound No. (2)]

A mixed solution composed of 12 g of poly(lauryl methacrylate), 100 g of vinyl acetate, 4 g of stearyl methacrylate and 385 g of isododecane was heated to 70° C. with stirring in a nitrogen current, and after addition of 1.7 g of AIBN, reacted for 6 hours. Forty minutes after the addition of the polymerization initiator, the uniform solution began to become whitely turbid, and the reaction temperature rose to 85° C. After cooling, the reaction mixture was passed through a 200-mesh nylon cloth. The resulting white dispersion was a latex having a polymerization conversion of 88% and an average particle diameter of 0.23 μm.

PRODUCTION EXAMPLE 3

Production of resin particles [Compound No. (3)]

A mixed solution composed of 12 g of poly(lauryl methacrylate), 100 g of vinyl acetate, 5.3 g of vinyl laurate and 380 g of Isopar G was heated to 75° C. with stirring in a nitrogen current, and after adding 1.7 g of AIBN, reacted for 6 hours. Twenty minutes after the addition of the polymerization initiator, the solution became whitely turbid, and the reaction temperature rose to 88° C. After cooling, the reaction mixture was passed through a 200-mesh nylon cloth. The resulting white dispersion was a latex having a polymerization conversion of 90% and an average particle diameter of 0.22 μm.

PRODUCTION EXAMPLE 4

Production of resin particles [Compound No. (4)]

A mixed solution of 14 g of poly(stearyl methacrylate) and 380 g of Shell Sol 71 was heated to 75° C. with stirring in a nitrogen current, and after adding another mixed solution composed of 100 g of vinyl acetate, 4 g of stearyl methacrylate and 1.7 g of AIBN dropwise over the course of 2 hours, the mixture was further stirred for 4 hours. After cooling, the reaction mixture was passed through a 200-mesh nylon cloth. The resulting white dispersion was a latex having a polymerization conversion of 85% and an average particle diameter of 0.23 μm.

PRODUCTION EXAMPLE 5

Production of resin particles [Compound No. (1)]

A mixed solution composed of 15 g of a copolymer of lauryl methacrylate and acrylic acid (copolymerization ratio 9:1 by mole), 100 g of vinyl acetate, 3 g of lauryl acrylate and 380 g of Isopar G was heated to 75° C. with stirring in a nitrogen current, and after adding 1.5 g of benzoyl peroxide, reacted for 6 hours. Ten minutes after the addition of the initiator, the solution became whitely turbid, and the reaction temperature rose to 90° C. Then, the temperature was raised to 100° C., and at this temperature, the mixture was stirred for 1 hour to distill off the remaining vinyl acetate. After cooling, the reaction mixture was passed through a 200-mesh nylon cloth. The resulting white dispersion was a latex having a polymerization conversion of 90% and an average particle diameter of 0.17 μm.

PRODUCTION EXAMPLE 6

Production of resin particles [Compound No. (5)]

A mixed solution composed of 4 g of poly(lauryl methacrylate), 100 g of vinyl acetate, 5 g of crotonic acid, 8 g of stearyl methacrylate and 468 g of Isopar E was heated to 70° C. with stirring in a nitrogen current, and after adding 1.7 g of AIBN, reacted for 6 hours. Then, the temperature was raised to 100° C., and the reaction mixture was stirred for 1 hour at this temperature to distill off the remaining vinyl acetate. After cooling, the reaction mixture was passed through a 200-mesh nylon cloth. The resulting white dispersion was a latex having a polymerization conversion of 85% and an average particle diameter of 0.16 μm.

PRODUCTION EXAMPLE 7

Production of resin particles [Compound No. (10)]

A mixed solution composed of 20 g of poly(lauryl methacrylate), 100 g of isopropyl methacrylate, 2 g of decyl methacrylate and 470 g of n-decane was heated to 70° C. with stirring in a nitrogen current, and after adding 1.7 g of AIBN, reacted for 2 hours. Several minutes after the addition of the polymerization initiator, the mixture began to become turbid in bluish white, and the reaction temperature rose to 90° C. After cooling, the reaction mixture was passed through a 200-mesh nylon cloth to remove coarse particles. The resulting white dispersion was a latex having a particle diameter of about 0.5 μm.

PRODUCTION EXAMPLE 8

Production of resin particles [Compound No. (6)]

A mixed solution composed of 18 g of a copolymer of lauryl methacrylate and 2-hydroxyethyl methacrylate (copolymerization ratio 8:2 by mole), 85 g of vinyl acetate, 15 g of N-vinylpyrrolidone, 4 g of vinyl stearate and 380 g of n-decane was heated to 75° C. with stirring in a nitrogen current, and after adding 1.7 g of AIBN, reacted for 4 hours. Furthermore, 0.5 g of AIBN was added, and the reaction mixture was further reacted for 2 hours. After cooling, the reaction mixture was passed through a 200-mesh nylon cloth. The resulting white dispersion was a latex having an average particle diameter of 0.20 μm.

PRODUCTION EXAMPLE 9

Production of resin particles [Compound No. (15)]

A mixed solution composed of 16 g of poly(decyl methacrylate), 100 g of vinyl acetate, 3.5 g of lauryl vinyl ether and 380 g of n-decane was heated to 75° C. with stirring in a nitrogen current, and after adding 1.5 g of AIBN, reacted for 4 hours. Furthermore, 0.7 g of AIBN was added, and the mixture was reacted for 2 hours. After cooling, the reaction mixture was passed through a 200-mesh nylon cloth. The resulting white dispersion was a latex having an average particle diameter of 0.18 μm.

PRODUCTION EXAMPLE 10 (COMPARISON A)

The procedure of Production Example 1 was repeated except that lauryl methacrylate was not used. There was obtained a white dispersion which was found to be a latex having a polymerization conversion of 85% and an average particle diameter of 0.2 μm.

PRODUCTION EXAMPLE 11 (COMPARISON B)

A mixed solution composed of 15 g of poly(lauryl methacrylate), 100 g of vinyl acetate and 385 g of isodecane was reacted in the same way as in Production Example 1. The resulting white dispersion was a latex having a polymerization conversion of 88% and an average particle diameter of 0.18 μm.

PRODUCTION EXAMPLE 12 (COMPARISON C)

Three grams of lauryl methacrylate was added to the white latex obtained in Production Example 10, and they were well stirred.

PRODUCTION EXAMPLE 13 (COMPARISON D)

The procedure of Production Example 2 was repeated except that 1.4 g of n-butyl methacrylate was used instead of stearyl methacrylate. The resulting white dispersion was a latex having a polymerization conversion of 89% and an average particle diameter of 0.32 μm.

PRODUCTION EXAMPLE 14 (COMPARISON E)

The procedure of Production Example 2 was repeated except that 1.7 g of n-hexyl methacrylate was used instead of stearyl methacrylate. The resulting white dispersion was a latex having a polymerization conversion of 87% and an average particle diameter of 0.25 μm.

PRODUCTION EXAMPLE 15

Production of resin particles [Compound No. (16)]

A mixed solution composed of 4 g of poly(lauryl methacrylate), 100 g of vinyl acetate, 5 g of crotonic acid, 8 g of stearyl methacrylate and 468 g of Isopar E was heated to 70° C. with stirring in a nitrogen current, and after adding 1.7 g of AIBN was added and the mixture was reacted for 6 hours. The reaction temperature was then raised to 100° C., and the mixture was stirred at this temperature for 1 hour. The reaction mixture was cooled, and passed through a 200-mesh nylon cloth. The resulting white dispersion was a latex having a polymerization conversion of 85% and an average particle diameter of 0.16 μm.

EXAMPLE 1

Ten grams of poly(lauryl methacrylate), 10 g of nigrosine and 30 g of Shell Sol 71 were put in a paint shaker (made by Tokyo Seiki Co., Ltd.) together with glass beads. They were shaken for 90 minutes to obtain a dispersion containing fine nigrosine particles.

Thirty grams of the resin dispersion obtained in Production Example 1, 2.5 g of the nigrosine dispersion and 0.03 g of octadecene/half maleic acid octadecylamide/N-octadecylmaleinimide copolymer were diluted with 1 liter of Shell Sol 71 to prepare a liquid developer for electrostatic photography.

COMPARATIVE DEVELOPERS A TO C

Comparative liquid developers A, B and C were prepared in the same way as above except that instead of the resin dispersion in the above procedure, the resin dispersion obtained in Production Example 10 (for liquid developer A), the resin dispersion obtained in Production Example 11 (for liquid developer B), and the resin dispersion obtained in Production Example 12 (for liquid developer C) were used respectively.

Each of the above liquid developers was used as a developer for a wholly automatic electronic plate-making machine (ELP 280, a product of Fuji Photo Film Co., Ltd.), and ELP masters (a product of Fuji Photo Film Co., Ltd.) which were an electrophotographic material, were exposed and subjected to a developing treatment. After 2000 ELP masters were processed, toner adhesion and contamination in the developing device was examined. The results are shown in Table 1.

TABLE 1

| No. | Test | Developer | Contamination of the Developing Device | Image on the 2000th Plate |
|---|---|---|---|---|
| 1 | Invention | Example 1 | Not contaminated | Clear |
| 2 | Comparison A | Developer A | Significantly contaminated | Dropping of letter, blurring of the solid portion, and background fogging occurred |
| 3 | Comparison B | Developer B | Significantly contaminated | Dropping of letter, blurring of the solid portion, and background fogging occurred |
| 4 | Comparison C | Developer C | Significantly contaminated | Dropping of letter, blurring of the solid portion, and background fogging occurred |

Developers Nos. 1 to 4 in Table 1 were prepared by the same method except using different resin dispersions. Only the developer prepared using the resin particles in accordance with this invention did not at all contaminate the developing device. In comparisons A to C, adhesion of the toner was observed in the vicinity of the roller. This shows that the resin particles in accordance with this invention evidently differ from those obtained in comparison A in which the monomer B was not used, those obtained in comparison C in which the monomer B was added to a dispersion of resin particles after polymerization and particle formation, and those obtained in comparison B in which a polymer of the monomer B was added in advance of polymerization and particle formation assuming that the monomer B polymerized totally irrespective of the monomer A forming particles.

The master plates for offset printing (ELP masters) obtained by using the developer of the invention had very clear images even after developing 2000 plates. By using such master plates, 3000 printed copies were obtained in a customary manner. Even after printing 3000 copies, clear prints could further be obtained.

The offset printing master plates obtained using the developers of comparisons A to C had a clear image on the first one, but after processing 2000 plates, the images were unclear with dropping of letters, blurring of the solid portion (i.e., the density partially lowers), background fogging, etc.

EXAMPLE 2

A liquid developerfor electrostatic photography was prepared by dispersing 30 g of resin dispersion obtained in Production Example 2, 2.5 g of the nigrosine dispersion obtained in Example 1, and 0.04 g of diisobutylene/half maleic acid octadecylamide copolymer in 1 liter of Shell Sol 71.

COMPARATIVE DEVELOPERS D AND E

Comparative liquid developers D and E were prepared in the same way as in the above procedure except that instead of the resin dispersion used, the resin dispersion obtained in Production Example 13 (for developer D) and the dispersion obtained in Production Example 14 (for developer E) were used respectively.

Each of the above liquid developers was used as a developer for a wholly automatic electronic plate making machine (ELP 280, a product of Fuji Photo Film Co., Ltd.), and ELP masters (electrophotographic materials produced by Fuji Photo Film Co., Ltd.) were exposed and subjected to a developing treatment. After processing 2000 ELP masters, toner adhesion and contamination in the developing device was observed. The results are shown in Table 2.

TABLE 2

| No. | Test | Developer | Contamination of the Developing Device | Quality of the Image on the 2000th Plate |
|---|---|---|---|---|
| 1 | Invention | Example 2 | Not contaminated | Clear |
| 2 | Comparison D | Developer D | Significantly contaminated | Dropping of letter, blurring of the solid portion, and fogging occurred |
| 3 | Comparison E | Developer E | Fairly contaminated | Dropping of letter, blurring of the solid portion, and fogging occurred |

The developers obtained by using the resin particles in accordance with this invention did not at all contaminate the developing device. In comparisons D and E, toner adhesion was observed in the vicinity of the roller. Comparisons D and E used resin particles obtained by using n-butyl methacrylate and n-hexyl methacrylate respectively as monomer (B) in an equimolar amount to the stearyl methacrylate used as monomer (B) in the preparation of the resin particles in accordance with this invention. The above results show that the resin particles in accordance with this invention are evidently superior to those obtained in comparisons D and E.

The master plates for offset printing (ELP masters) obtained by using the developer of the invention had very clear images even after developing 2000 plates. When using such master plates, 3000 printed copies were obtained in a customary manner, clear prints could be obtained even after printing 3000 copies.

The offset printing master plates obtained using the developers of comparisons D and E had a clear image on the first one, but after processing 2000 plates, the images were unclear with dropping of letters, blurring of the solid portion, background fogging, etc.

EXAMPLE 3

A mixture of 100 g of the white dispersion obtained in Production Example 1 and 1.5 g of Sumikaron Black was heated to 100° C., and heated for 4 hours with stirring. After cooling to room temperature, the product was passed through a 200-mesh nylon cloth to remove the remaining dye. Thus, a black resin dispersion having an average particle diameter of 0.20 μm was obtained.

The black resin dispersion obtain (32 g) and 0.05 g of zirconium naphthenate were diluted with 1 liter of Shell Sol 71 to prepare a liquid developer.

The developer was used in the same device as in Example 1. After processing 2000 plates, toner adhesion and contamination did not at all occur in the developing device.

EXAMPLE 4

A mixture of 100 g of the white dispersion obtained in Production Example 6 and 3 g of Victoria Blue B was heated to 70° to 80° C., and stirred for 6 hours. After cooling to room temperature, the product was passed through a 200-mesh nylon cloth to remove the remaining dye. There was obtained a blue resin dispersion having an average particle diameter of 0.16 μm.

The above blue resin dispersion (32 g) and 0.05 g of zirconium naphthenate were diluted in 1 liter of Isopar H to prepare a liquid developer.

The liquid developer was used for development in the same device as used in Example 1. After processing 2000 plates, toner adhesion and contamination was not at all observed in the device. The images on the resulting offset printing master plates were clear. After printing 3000 copies, the images were still very clear.

EXAMPLE 5

The white resin dispersion obtained in Production Example 2 (32 g), 2.5 g of the nigrosine dispersion obtained in Example 1, and 0.02 g of a half docosanylamide of diisobutylene/maleic anhydride copolymer were diluted with 1 liter of Isopar G to prepare a liquid developer.

The liquid developer was used for development in the same device as used in Example 1. After processing 2000 plates, toner adhesion and contamination was not observed in the device. The images of the resulting offset master plates were clear. After printing 3000 copies using the master plates, the images of the prints were clear.

When this developer was left to stand for 3 months and then used in the same processing operation as above, the results were the same as those obtained before standing.

EXAMPLE 6

Ten grams of poly(decyl methacrylate), 30 g of Isopar H and 8 g of Alkali Blue were put in a paint shaker together with glass beads, and shaken for 2 hours to prepare a dispersion containing fine particles of Alkali Blue.

A liquid developer was prepared by diluting 30 g of the white resin dispersion obtained in Production Example 3, 4.2 g of the dispersion of Alkali Blue obtained as above and 0.02 g of a half docosanylamide of diisobutylene/maleic anhydride copolymer with 1 liter of Isopar G.

The developer was used for development in the same device as used in Example 1. After processing 2000 plates, toner adhesion and contamination was not observed in the device. The images on the resulting offset printing master plates and the images on printed copies after printing 3000 copies were both very clear.

EXAMPLE 7

A mixture of 100 g of the white dispersion obtained in Production Example 15, 3 g of Aizen Basic Cyanine 6GHB and 15 g of ethanol was heated to 70° to 80° C., and stirred for 2 hours. Then, while the pressure of the mixture was reduced by an aspirator, it was stirred at the same temperature for 2 hours. The mixture was heated, cooled, and passed through a 200-mesh nylon cloth to remove the remaining dye and obtain a blue resin dispersion having an average particle diameter of 0.16 μm.

A liquid developer was prepared by diluting 32 g of the resulting blue resin dispersion and 0.04 g of 1-octadecene/half maleic acid octadecylamide copolymer with 1 liter of Isopar H.

The liquid developer was used for development in the same device as used in Example 1. After processing 2000 plates, toner adhesion and contamination was not at all observed in the device. The images on the resulting offset printing master plates were clear. After printing 3000 copies, the images were still very clear.

EXAMPLES 8 to 11

In each run, a liquid developer was prepared in the same way as in Example 7, except that each of the following dyes were used instead of Aizen Basic Cyanine 6GHB.

When the liquid developer was used in the same device as in Example 1, the same results as in Example 7 were obtained.

Example 8: Aizen Cathilon Yellow 3GLH (Hodogaya Chemical Co.)

Example 9: Aizen Astra Phloxine FF (Hodogaya Chemical Co.)

Example 10: Aizen Cathilon Pink FGH (Hodogaya Chemical Co.)

Example 11: Methylene Blue

While the invention has been described in detail and with reference to specific embodiments thereof, it will be apparent to one skilled in the art that various changes and modifications can be made therein without departing from the spirit and scope thereof.

What is claimed is:

1. A method for producing an electrostatic photographic liquid developer comprising (i) forming a dispersion of copolymer resin particles by polymerizing a solution containing at least one monofunctional monomer (A) which is soluble in a non-aqueous solvent but becomes insoluble upon polymerization and at least one monomer (B) containing an aliphatic group having at least 8 carbon atoms, being copolymerizable with the monomer (A) and being represented by the following formula (I):

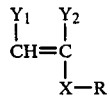

(I)

wherein R represents an aliphatic group having at least 8 carbon atoms, X represents —COO—, —CONH—,

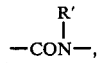

wherein R′ represents an aliphatic group, —OCO—, —$CH_2$OCO— or —O—, and $Y_1$ and $Y_2$ are the same different and each represents hydrogen, an alkyl group, —COOR″ or —$CH_2$COOR″, wherein R″ represents an aliphatic group, in the presence of a resin being soluble in said solvent and having no grafting group polymerizable with the monomers and of a non-aqueous solvent miscible with said solvent, with the monomer (B) being used in an amount of 0.1 to 5 mole % based on the amount of the monomer (A); and (ii) adding a non-aqueous solvent to the dispersion of copolymer resin particles to adjust the properties of a carrier liquid in the resulting diluted dispersion of copolymer resin particles to an electric resistance of at least $10^9$ ohms-cm and a dielectric constant of not more than 3.5.

2. The method as claimed in claim 1, wherein in formula (I), R represents an alkyl or alkenyl group having at least 10 carbon atoms in total which may be substituted, X represents —COO—, —CONH—,

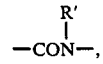

wherein R′ represents an aliphatic group having 1 to 32 carbon atoms, —OCO—, —$CH_2$OCO— or —O—, and each of $Y_1$ and $Y_2$ represents hydrogen, a methyl group, —COOR″ or —$CH_2$COOR″, wherein R″ represents an alkyl, alkenyl, aralkyl or cycloalkyl group having 1 to 32 carbon atoms.

3. The liquid developer as claimed in claim 1, wherein in formula (I), X represents —COO—, —CONH— or

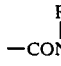

wherein R' represents an aliphatic group having 1 to 32 carbon atoms, and each of $Y_1$ and $Y_2$ represents a hydrogen atom or a methyl group.

4. The method as claimed in claim 1, wherein monomer (B) is used in an amount of 0.5 to 5 mole % based on the amount of monomer (A).

5. The method as claimed in claim 1, wherein said non-aqueous solvent is selected from the group consisting of a straight-chain or branch-chain aliphatic hydrocarbon, an alicyclic hydrocarbon, an aromatic hydrocarbon and a halogenated hydrocarbon.

6. The method as claimed in claim 1, wherein said resin (2) is selected from the group consisting of polymers or co-polymers of acrylic, methacrylic or crotonic esters which contain alkyl or alkenyl chains having 6 to 32 carbon atoms in total, higher fatty acid vinyl esters, alkyl vinyl esters or olefins, and copolymers obtained by polymerizing monomers capable of forming polymers soluble in the non-aqueous solvents and at least one of the various monomers in a proportion such that the resulting copolymer are soluble in non-aqueous solvents.

7. The method as claimed in claim 1, wherein said resin (2) is selected from the group consisting of alkyd resins, alkyd resins modified by fatty acids, linseed oil and modified polyurethane resins.

8. The method as claimed in claim 1, wherein said monomer (A) is selected from the group consisting vinyl and allyl esters of aliphatic carboxylic acids having 1 to 3 carbon atoms, $C_1$–$C_3$ alkyl esters or alkylamides of unsaturated carboxylic acids, styrene and styrene derivatives, unsaturated carboxylic acids, anhydrides of unsaturated carboxylic acids, hydroxyethyl methacrylate, hydroxyethyl acrylate, diethylaminoethyl methacrylate, N-vinylpyrrolidone, and acrylonitrile.

9. The method as claimed in claim 1, wherein said resin (1) has a molecular weight of $10^3$ $10^6$.

10. The method as claimed in claim 9, wherein the amount of said resin (1) is 0.5 to 5 parts by weight per 1000 parts by weight of the non-aqueous solvent.

11. The method as claimed in claim 1, wherein said resin (2) is employed in an amount of 1 to 100 parts by weight per 100 parts by weight of the total of monomers (A) and (B).

12. The method as claimed in claim 1, wherein said resin (2) is employed in an amount of 5 to 50 parts by weight per 100 parts by weight of the total of monomers (A) and (B).

13. A method for producing an electrostatic photographic liquid developer comprising (i) forming a dispersion of copolymer resin particles by polymerizing a solution containing at least one monofunctional monomer (A) which is soluble in a non-aqueous solvent but becomes insoluble upon polymerization and at least one monomer (B) containing an aliphatic group having at least 8 carbon atoms, being copolymerizable with the monomer (A) and being represented by the following formula (I):

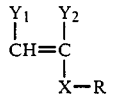

(I)

wherein R represents an aliphatic group having at least 8 carbon atoms, X represents —COO—, —CONH—,

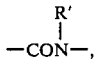

wherein R' represents an aliphatic group, —OCO—, —$CH_2$OCO— or —O—, and $Y_1$ and $Y_2$ are the same or different and each represents hydrogen, an alkyl group, —COOR" or —$CH_2$COOR", wherein R" represents an aliphatic group, in the presence of a resin being soluble in said solvent and having no grafting group polymerizable with the monomers and of a non-aqueous solvent miscible with said solvent, with the monomer (B) being used in an amount of 0.1 to 5 mole % based on the amount of the monomer (A); and (ii) coloring the copolymer resin particles by dissolving at least one organic dye in the dispersion of copolymer resin particles and heating the mixture; and (iii) adding a non-aqueous solvent to the dispersion of colored copolymer resin particles to adjust the properties of a carrier liquid in the resulting diluted dispersion of copolymer resin particles to an electric resistance of at least $10^9$ ohms-cm and a dielectric constant of not more than 3.5.

14. The method for producing electrostatic photographic liquid developer as claimed in claim 13, wherein said at least one organic dye is dissolved in an organic solvent, the thus obtained organic dye solution being mixed with the dispersion of copolymer resin particles, and the thus obtained mixture being heated.

15. The method for producing electrostatic photographic liquid developer as claimed in claim 14, wherein after heating the mixture, said organic solvent for dissolving the organic dye is removed.

16. The method as claimed in claim 13, wherein in formula (I), R represents an alkyl or alkenyl group having at least 10 carbon atoms in total which may be substituted, X represents —COO—, —CONH—,

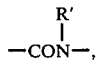

wherein R' represents an aliphatic group having 1 to 32 carbon atoms, —OCO—, —$CH_2$OCO— or —O—, and each of $Y_1$ and $Y_2$ represents hydrogen, a methyl group, —COOR" or —$CH_2$COOR", wherein R" represents an alkyl, alkenyl, aralkyl or cycloalkyl group having 1 to 32 carbon atoms.

17. The method as claimed in claim 13, wherein the organic dye is used in an amount of at least 0.5% by weight based on the weight of the resin (1).

18. The method as claimed in claim 7, wherein the organic dye is used in an amount of 3 to 20% by weight based on the weight of the resin (1).

19. The method as claimed in claim 7, wherein the heating is carried out at 40° to 150° C. for 30 minutes to 12 hours.

20. The method as claimed in claim 13, wherein the organic dye is dissolved in the dispersion of the resin and a solvent capable of swelling the resin (1) is contained to the mixture in an amount of at least 0.1 time the weight of the resin (1).

21. The method as claimed in claim 20, wherein the solvent is used in an amount of 0.1 to 10 times the weight of the resin (1).

22. The method as claimed in claim 1, wherein the particle diameter of said resin particles is up to about 0.5 μm.

23. The method as claimed in claim 13, wherein the particle diameter of said resin particles is up to about 0.5 μm.

24. The method as claimed in claim 1, wherein said resin particles are obtained as a direct product of said polymerizing.

25. The method as claimed in claim 13, wherein said resin particles are obtained as a direct product of said polyermizing.

* * * * *